US006698030B2

(12) United States Patent
Cutler

(10) Patent No.: US 6,698,030 B2
(45) Date of Patent: Mar. 2, 2004

(54) NECK PRESSURE RELIEF PAD

(76) Inventor: David W. Cutler, P.O. Box 4466, Thousand Oaks, CA (US) 91359

( * ) Notice: Subject to any disclaimer, the term of this patent is extended or adjusted under 35 U.S.C. 154(b) by 0 days.

(21) Appl. No.: 10/137,239

(22) Filed: May 1, 2002

(65) Prior Publication Data

US 2003/0204897 A1 Nov. 6, 2003

(51) Int. Cl.[7] ..... A41D 13/00
(52) U.S. Cl. ..... 2/267; 450/86
(58) Field of Search ..... 2/267, 52, 268, 2/468, 455, 459, 460, 461, 44, 129, 311, 312, 318, 319, 321, 322, 326–330, 333, 336, 341, 342, 45; 450/86, 87, 77, 26, 28; 224/642, 643, 647, 656, 257, 258, 264, 265, 600, 603–605, 607, 608, 625, 191; 602/18, 78; 24/3.4, 71 TD, 71 SK, 712, 712.1, 712.2, 115 R, 128, 129 R, 129 B, 129 D, 129 A, 298–302

(56) References Cited

U.S. PATENT DOCUMENTS 1,631,694 A * 6/1927 Rick ..... 2/336
2,485,720 A * 10/1949 Elliott et al. ..... 2/336
3,050,734 A * 8/1962 Dopyera ..... 2/268
3,154,787 A * 11/1964 Newman ..... 2/268
4,769,875 A * 9/1988 Hartman ..... 24/300
4,795,399 A * 1/1989 Davis ..... 450/86
5,348,505 A * 9/1994 Rothhammer ..... 441/117
5,555,584 A * 9/1996 Moore, III et al. ..... 12/142 N
6,202,214 B1 * 3/2001 Light ..... 2/45

* cited by examiner

*Primary Examiner*—Gloria M. Hale
(74) *Attorney, Agent, or Firm*—Michael G. Petit

(57) ABSTRACT

A neck protector for a taut ligature such as a bra or bathing suit strap. The neck protector is a perforated, generally elongate closed-cell foam body having unitary construction. The foam body is preferably a flat sheet having a length, a flat upper surface, a lower skin-contacting surface and at least four holes in the flat upper surface thereof. The four or more holes are symmetrically disposed laterally around the center of the flat upper surface along the length of the foam body. In use, the two opposing ends of a ligature are threaded downwardly through the outermost holes in the upper surface on each end of the foam body and are then threaded upwardly through adjacent respective holes in the lower surface thereof. The free ends of the ligature are then tied together with the lower skin-contacting surface of the neck protector positioned on the nape of the neck. The pressure of the taut ligature against the neck is distributed over the flat lower skin-contacting surface of the neck protector thereby reducing discomfort from the pressure of the ligature. The unitary construction prevents delamination and subsequent destruction of the neck protector, even when wet.

3 Claims, 1 Drawing Sheet

NECK PRESSURE RELIEF PAD

BACKGROUND OF THE INVENTION

1. Field of the Invention

The present invention relates to pressure relief pads and, more particularly, to a pressure relief pad operable for relieving the pressure of a ligature such as a bra or bathing suit strap on the nape of the neck.

2. Prior Art

Pads operable for relieving the pressure applied to skin of a person's shoulder by a taut ligature such as a bra strap or the strap of a carrying case are well known in the art. Representative pressure relief pads in accordance with the prior art are disclosed, for example, in U.S. Pat. Nos. 4,795,399, 4,472,838, 3,229,694, 3,154,787, 2,485,720 and 1,546,067. All of the forgoing patents disclose a pad having a laminate composition; that is, the pads are not of unitary construction and may delaminate or otherwise separate upon continued use and exposure to an aggressive environment such as water.

U.S. Pat. No. 2,501,749 to Trent discloses a pressure relief-type of shoulder pad that has unitary construction. The pad comprises a flat, oblong sheet of a semi-rigid material such as plastic having an "S" shaped cutout therein. The cutout provides a pair of directionally opposed prongs in the pad through which a strap may be passed and secured to the pad. The pad must be made from a relatively rigid plastic or else the strap, when taut, will bend the prongs and the strap will release unintentionally. The rigidity required of the material precludes facile conformation of the pad to a highly curved surface such as the nape of the neck. Further, all of the forgoing pressure relief pads are designed for placement upon the shoulder of the wearer. There is a need for a comfortable pressure relief pad for use with a ligature that is sufficiently flexible to allow contour-conforming placement behind the neck of a wearer and having unitary construction.

SUMMARY

A pressure relief pad comprising or consisting essentially of a unitary, ellipsoidal, elastomeric foam body having a center, a length, a thickness, a substantially flat upper surface and a lower skin-contacting surface in opposition to the upper surface. The pad has at least four holes on the upper surface thereof. The holes extend downwardly through the thickness of the foam body. The holes are symmetrically spaced laterally along the upper surface with respect to the center of the pad. The pad consists of a single sheet of compressible elastomeric foam. The diameter of the holes is dimensioned to permit the passage of a ligature therethrough.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DESCRIPTION OF THE PREFERRED EMBODIMENTS

Figure 1:
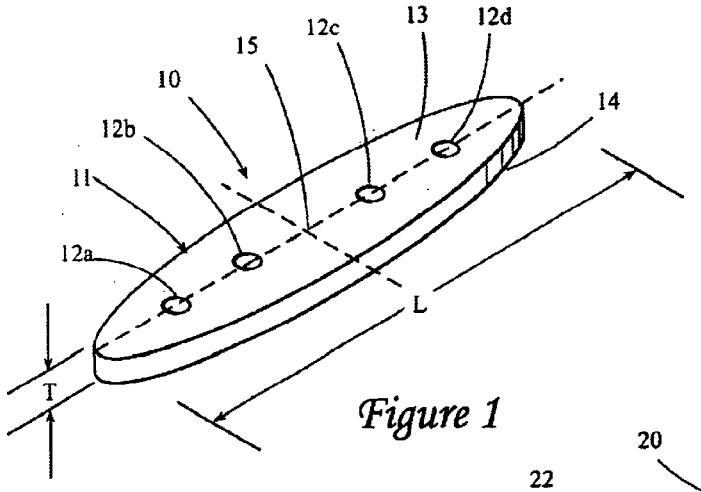
FIG. 1 is a perspective view of a pressure relief pad in accordance with the present invention.

FIG. 1 is a perspective view showing a pressure relief pad in accordance with the present invention. The pressure relief pad 10 comprises a unitary elastomeric foam body 11 having four holes 12*a–d* therein. The elastomeric foam body 11 has an upper surface 13, a lower skin-contacting surface 14, a length L, a thickness T and a center 15. The holes 12*a–d* each has a depth equal to the thickness T and are symmetrically distributed about the center 15 along the length L of the upper surface 13. The pressure relief pad 10 consists of the elastomeric foam body 11 with at least four holes 12*a–d* therein.

Figure 2:
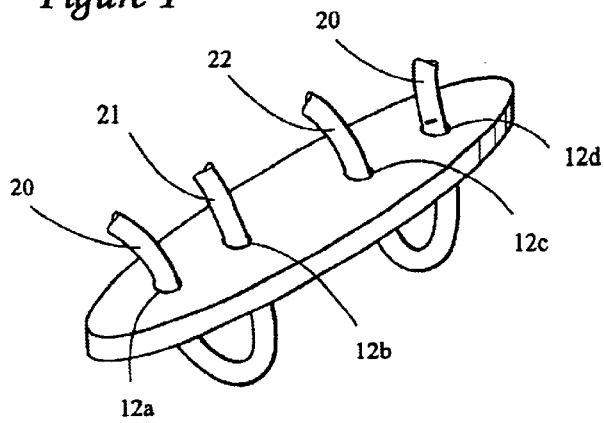
FIG. 2 is a perspective view of the pressure relief pad of FIG. 1 illustrating the opposing ends of a ligature such as string correctly threaded through the holes in the pad in preparation for attachment to one another.

The pressure relief pad 10 is preferably made in a single operation by die cutting both the foam body 11 and the holes 12*a–d* from a sheet of elastomeric foam having a thickness between 1 and 6mm. Suitable materials include neoprene, polyurethane and any hypoallergenic elastomeric foam. The foam is most preferable a moderately compressible closed-cell foam elastomeric sheet that does not significantly take up water when submerged and is quick-drying. The soft compliant peripheral edges of the pressure relief pad 10 resist abrading or otherwise irritating the skin during prolonged periods of activity, such as while swimming. A preferred overall shape of the pressure relief pad 10 is ellipsoidal, as shown in FIGS. 1 and 2, though other elongate shapes are satisfactory and may be ornamental so long as the pad 10 is elongate (i.e. the length L is the greatest dimension). The flexibility of the closed-cell foam pad 10 enables the pad to conform to the arcuate contours on the nape of the neck.

Figure 3:
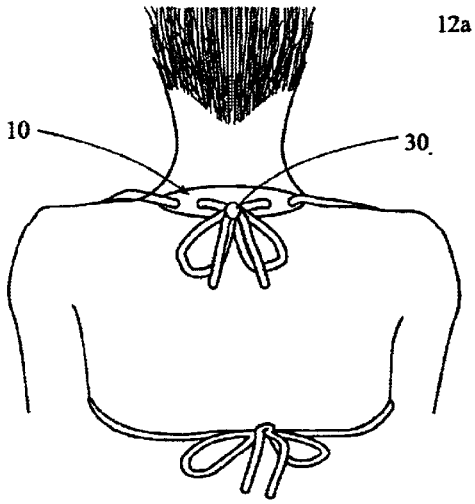
FIG. 3 is a perspective view illustrating the use of the pressure relief pad of the present invention by a bather, the pad positioned at the nape of the bather's neck with a ligature comprising a cord supporting the top portion of a bathing suit attached thereto.

Turning now to FIGS. 2 and 3, a method for attaching the pressure relief pad 10 to a ligature such as a bathing suit strap or string is illustrated. The ligature 20 has opposing free ends 21 and 22. Free ends 21 and 22 are threaded downwardly through holes 12*a* and 12*d* respectively, and then threaded upwardly through holes 12*b* and 12*c* respectively. The pressure relief pad is then placed upon the nape of the neck and tightened by pulling the free ends 21 and 22 together. The free ends are then tied together to form a knot 30 as shown in FIG. 3 such that the center 15 of the pad 10 is interposed between the ligature knot 30 and the person's neck. The unitary construction of the pad 10 resists delamination while the soft compressible foam body prevents chafing and irritation during activity and is sufficiently flexible to readily conform to the contours on the nape of the neck.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A pressure relief pad operable for attachment to a pair of neck straps on a bathing suit, thereafter to be interposed between the bathing suit neck straps and the neck of the bathing suit wearer to distribute the pressure from the neck straps against the skin on the nape of the wearer's neck, the pressure relief pad-comprising an elongate, flexible elastomeric foam body having a length, a thickness, a substantially flat rectangular upper surface and a lower skin-contacting surface in opposition to said upper surface with four holes on said upper surface extending through said thickness of said foam body, said four holes being symmetrically disposed on said upper surface with respect to a center of said length.

2. A pressure relief pad in accordance with claim 1 wherein said foam pad comprises a closed-cell foam.

3. A pressure relief pad operable for attachment to a pair of neck straps on a bathing suit, thereafter to be interposed between the bathing suit neck straps and the neck of the bathing suit wearer to distribute the pressure from the neck straps against the skin on the nape of the wearer's neck, the pressure relief pad consisting essentially of a unitary ellipsoidal, elastomeric foam body having a length, a thickness, a substantially flat upper surface and a lower skin-contacting surface in opposition to said upper surface with at least four holes on said upper surface extending downwardly through said thickness of said foam body, said at least four holes being symmetrically disposed laterally on said upper surface with respect to a center of said length.

* * * * *